US010883222B2

(12) United States Patent
Lewis et al.

(10) Patent No.: US 10,883,222 B2
(45) Date of Patent: Jan. 5, 2021

(54) ATTACHMENT TO CONVERT A STANDARD HANDHELD HAIR BLOW DRYER INTO A DEVICE THAT CAN BE USED TO IRON CLOTHING

(71) Applicants: Vivian Lou Lewis, Newport Beach, CA (US); Natashia Natalie Lewis, Newport Beach, CA (US)

(72) Inventors: Vivian Lou Lewis, Newport Beach, CA (US); Natashia Natalie Lewis, Newport Beach, CA (US)

( * ) Notice: Subject to any disclaimer, the term of this patent is extended or adjusted under 35 U.S.C. 154(b) by 56 days.

(21) Appl. No.: 16/190,171

(22) Filed: Nov. 14, 2018

(65) Prior Publication Data

US 2019/0169786 A1 Jun. 6, 2019

Related U.S. Application Data

(60) Provisional application No. 62/557,177, filed on Sep. 12, 2017.

(51) Int. Cl.
*D06F 69/00* (2006.01)
*D06F 73/00* (2006.01)

(52) U.S. Cl.
CPC ..... *D06F 69/00* (2013.01); *D06F 73/00* (2013.01)

(58) Field of Classification Search
CPC ..... D06F 69/00; D06F 73/00; D06F 75/34; D06F 75/36; D06F 75/38; H05B 1/00; H05B 1/0255; F24H 3/02; F24H 3/04; F24H 3/0411; F24H 3/0423
USPC ..... D32/68; D28/12, 18
See application file for complete search history.

(56) References Cited

U.S. PATENT DOCUMENTS 3,258,578 A * 6/1966 Ferris ..... F24H 1/00 392/404
3,486,256 A * 12/1969 Lachman ..... D06F 75/00 38/88
4,524,263 A * 6/1985 Yamac ..... D06F 75/30 126/411
4,685,229 A * 8/1987 Moravek ..... D06F 75/30 38/84
4,857,706 A * 8/1989 Diamond ..... D06F 75/30 392/383
5,170,038 A * 12/1992 Aida ..... D06F 75/30 219/228
6,173,718 B1 * 1/2001 Okumoto ..... A45D 1/04 132/224
6,494,216 B1 * 12/2002 Hirata ..... A45D 2/001 132/224

(Continued)

*Primary Examiner* — Ismael Izaguirre

(57) ABSTRACT

This invention is able to attach to standard handheld hair blow dryers, and can turn most standard hair blow dryers into an iron, for wrinkle free clothing and fabric. The invention allows the same tool to be used to dry your hair, and converted into an iron by attaching this device. This newly invented attachment, allows you to blow dry your hair and iron your clothes, without the risk of scorching fabric, using your standard blow dryer. This invention enables ironing even with clothes on a hanger. This invention, when attached to a standard blow dryer, conveniently may be used to dry clothing fast, after exposure to rain, snow, beach environments and at the same time remove wrinkles. It is portable, lightweight, metal-free, biodegradable, and conforms to the size of most standard dryers, making it ideal for air travel.

6 Claims, 1 Drawing Sheet

(56) References Cited

U.S. PATENT DOCUMENTS

| | | | | |
|---|---|---|---|---|
| 6,516,535 | B1 * | 2/2003 | Chen | A45D 20/10<br>219/245 |
| 2003/0070331 | A1 * | 4/2003 | Chen | A45D 20/12<br>38/84 |

* cited by examiner

ATTACHMENT TO CONVERT A STANDARD HANDHELD HAIR BLOW DRYER INTO A DEVICE THAT CAN BE USED TO IRON CLOTHING

The described invention (Hot Air Iron Attachment) was made with 3D molding.

The Hot Air Iron Attachment is square shaped, designed to fit onto the portion of the blow dryer that emits hot air. The air vents that allow hot air to be forced through without scorching fabric. The controlled area of hot air through the vents, removes wrinkles from fabrics quickly. This attachment fits most standard blow dryers.

Wrinkle free clothing can be achieved fast with the invention attached to a standard blow dryer, when used as an iron, with the same motion used in operating atypical clothing iron.

The square shape can be rotated to use the angular, inverted v-shaped corner, to iron hard to get to corners and other areas. The biodegradable material can withstand the hot air temperature from the blow dryer. With proper usage the result is wrinkle free clothing.

CROSS-REFERENCE TO RELATED APPLICATIONS

Prior-Filed Co-pending non-provisional Application in Data Sheet
37 CFR 1.76 37CFR1.78

BACKGROUND OF THE INVENTION

1. Field of the Invention

The present invention relates to ironing clothing and fabric, to achieve a wrinkle free finish. This Hot Air Iron attachment invention, specifically relates to creating a new option for ironing. The hot air controlled and released through the air vents of the invention used with a standard hair blow dryer, removes wrinkles fast from fabric. This is achieved without the usage of steam or an ironing board. The requirement of using a standard conventional iron or steamer, is no longer the only option, for removing wrinkles from fabric.

2. Description of the Prior Art Design of an Iron

The clothes iron typically has a triangular surface. When it's used to press clothes and sometimes create creases. This invention was named for the metal, which the device materials were commonly made. When used for wrinkles, flattening fabric and creasing, it was called ironing.

The problem with the conventional clothes iron, is that it may require steam and is a larger device. There is the possibility, of fabric being scorched during the process of ironing. It requires to use an ironing board or flat surface, unlike the hot air iron attachment invention, does not require either.

There is a higher risk of skin burns with the usage of the conventional iron. The conventional iron is not suitable for easy travel through airports, due to its metal material. It is a device convenient for hotel stays and travel. This invention can fit into a pocket, handbag, or small space. Convenient, it attaches to most standardized hair blow dryers.

This new invented hot air iron attachment, in many respects, substantially departs from the conventional iron.

SUMMARY OF THE HOT AIR IRON ATTACHMENT INVENTION

The concepts and designs of the prior art and invention of the iron, is different from the Hot Air Iron Attachment. This new invention has been developed with the purpose in mind, to create an option other than the conventional metal iron, for ironing clothing. Also, to eliminate the need for using an ironing board and steam, for ironing. The Hot Air Iron Attachment, utilizes, one tool, to dry hair and iron clothing. The concept of this design is more suitable for fast easy no mess ironing. This invention is also bio-degradable.

Hot Air Iron Attachment Design and Shape

1. Rectangular body shape—can be rotated to form a V shape, for tight corners and creasing clothing.
2. This invention is not limited to its application, or to the details described relating to its construction.
3. The invention is not limited to, the arrangements of the construction and arrangements of the components set forth in the description, illustration or drawings.
4. The invention is capable of other embodiments and of being utilized in various ways.
5. It is to be determined that phraseology and terminology employed herein, are for the purpose of the inventions description and should not be regarded as limiting.

Conventional Standard Irons Verses the Hot Air Iron Attachment

A. Conventional Irons

1. The conventional Iron uses electrical heat through the metal device, for ironing.
2. May require steam for ironing clothing
3. It is not convenient for travel due to size and PSA
4. Under certain circumstances, scorching can occur and a shiny finish on fabric B. Hot Air Iron Attachment 1. The Hot Air Iron Attachment is made of biodegradable materials
2. It uses hot air for ironing, which is forced through the air vents with control.
3. The invention fits into pockets, handbags, takes up little space.
4. An ironing board is not needed for ironing clothing.
5. The Hot Air Iron Attachment can iron clothing, while on hangers.
6. This new invention can be used to dry wet clothing, even while you are wearing them, (coming in from the rain, snow, beach, etc)
7. This invention will not scorch clothing
8. It reduces the chances of skin burns
9. This Hot Air Iron Attachment utilizes one household gadget (the blow dryer) to dry hair and iron clothing.

The newly invented Hot Air Iron attachment is:

Portable, scorch free, increases the utility a household hair blow dryer

Mechanism is unique: The Hot Air Attachment prevents the hot air from coming in direct contact to the fabric. The hot is only directed at it.

The Hot Air Iron Attachment can iron clothing like the traditional method of ironing, with a metal iron. This one Hot Air Iron Attachment can be used on a variety of hair blow dryers.

Travel steamers need water, this Hot Air Iron Attachment does not need water.

This Hot Air Iron Attachment can go through TSA at the airport and is great for hotel rooms to replace the larger standard iron.

There is no physical contact with the fabric, eliminating, the shine on some fabrics that metal leaves behind.

The Hot Air Iron Attachment is heat safe for fabric, will not melt with normal usage, can be safely used on a wider range of fabrics.

Decreases the chances of possible skin burns since there is no metal on the attachment. It's very light weight, compact, easily fits into a purse, pocket, handbag, etc.

It creates more usage for an existing device, most people already have in their household.

BRIEF SUMMARY OF THE INVENTION

The invention has many advantages for wrinkle free clothing. It is great for travel, the convince of ironing your clothing, with the same device you use for blow drying your hair. This device uses hot air to removing wrinkles from clothing and fabric. This device does not need steam and will not scorch fabric.

The invention can also be used to dry wet clothing from rain, snow, the beach exposure, which creates wet wrinkle clothes. Ironing with this attachment with a standardized blow dryer, does not require an ironing board. Clothing can be ironed while on a hanger or a flat area.

This newly invented blow dryer attachment is a great device for hotels and traveling. The standard iron can be eliminated during travel, to save space.

It solves many previous problems, regarding traveling with clothing irons. Hair and ironing of clothing, can be done with this convenient small attachment plus a hair blow dryer.

Hair dried with wrinkle free clothing done fast, without a mess and convenient.

DETAILED DESCRIPTION OF FIGURES

Figures 1, 2, 3, 4:
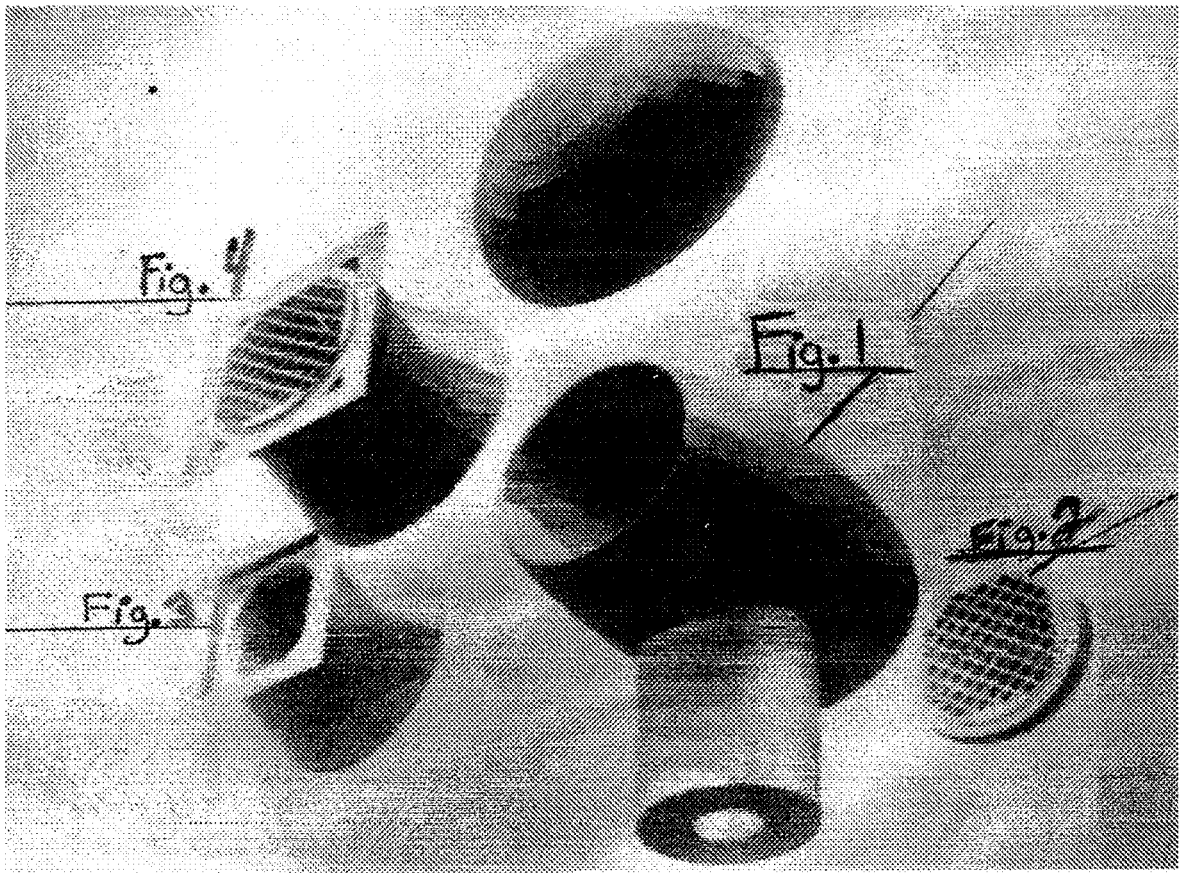
FIG. 1 STANDARD HAIR BLOW DRYER
FIG. 2 HOT AIR IRON VENT COVER ATTACHMENT
FIG. 3 HOT AIR IRON ATTACHMENT FOR STANDARD HAIR BLOW DRYER
FIG. 4. COMPLETE ATTACHMENT WITH VENT

1. STANDARD HAIR BLOW DRYER TO BE ATTACHED TO THE HOT AIR IRON, FOR USAGE AS AN IRON FOR (FABRICS, CLOTHES, CLOTHES DRYER, ETC.)

2. VENT FOR HOT AIR IRON TO HELP REGULATE TEMPERATURE AND PROTECT FABRIC BEING IRONED.

3. HOT AIR IRON ATTACHMENT PART WITHOUT VENT ATTACHED TO IT.

4. HOT AIR IRON COMPLETE WITH VENT PART ATTACHED. READY FOR ATTACHMENT TO STANDARD HAIR BLOW DRYER.

DETAILED DESCRIPTION OF THE INVENTION

Universal heat resistant plastic attachment for standard sized handheld hair blow dryer, that enables it to be used as a device to iron clothing, removing wrinkles and creating creases. As an alternative to a removable attachment, the body shape and design of the attachment can be incorporated into a composite (non-detachable, one piece) heat resistant shell for the internal mechanical components of a blow dryer. This would allow for the unit to function as one part, without a removable attachment, to provide the same functionalities described above. In the composite (one piece) design, the design and structure of the device that allows air to pass through, and make contact with the fabric, is the same as when it is to be used as an attachment. Thus, in the composite design the new device (attachment structure) merely replaces the typically shaped nozzles of existing blow dryer body designs. The circular end of the tube-like attachment fits over the nozzle of a standard sized handheld hair blow dryer.

The flat square front of the attachment contains air vents throughout the front panel, for hot air to pass through the attachment and onto cloth for pressing fabric and removing wrinkles. Once a hair dryer has been fitted with the invented above-described attachment, pressing it against cloth will serve the purpose typically performed by a clothes iron. The device releases the necessary heat for spot ironing, wrinkle removal, creasing, and easy ironing. The square panel can be rotated to for ease of use, and to reach into small spaces of clothing and button holes.

Again, the invention allows a typical blow dryer unit to be converted into a device capable of pressing clothing or garments, through the attachment of this heat resistant plastic component. Or alternately, the invented plastic component can be integrated or fused into a composite one-piece design of the dryer body that serves as the casing for the internal mechanical components of a typical blow dryer unit, thus enabling a permanent fixed unit capable of wrinkle removal and creasing garments utilizing the application of hot air.

The invention claimed is:

1. A method for removing wrinkles from clothing or fabric without use of a traditional soleplate, the method comprising:

providing an attachment comprising a ventilation grille attachable to a distal end of a blow dryer, and attaching said attachment to the blow dryer in order to utilize the apparatus for removing wrinkles from fabric or clothing with the hot air traveling through the ventilation grille of said attachment;

wherein said attachment comprising a hollow central portion, terminating in a ventilation grille panel, whereby the said hollow central portion is further comprising a shape that tapers from the proximal end towards the terminal ventilation grille panel, whereby the proximal end of said hollow central portion is further able to receive the barrel of the blow dryer, holding the barrel of the blow dryer in communication with the hollow portion of the attachment so that air from the blow dryer can pass through the ventilation grille panel;

wherein said ventilation grille panel comprising a grille surrounded by a thin marginal frame is placed on fabric or clothing, allowing the hot air to travel through the vents and remove wrinkles;

wherein said ventilation grille comprises diamond-shaped air vents spanning the entirety of the grille surface.

2. An attachment for use with a blow dryer for ironing or removing wrinkles from clothing or fabric without use of a traditional soleplate, the apparatus comprising:

an attachment for attachment to the distal end of a blow dryer; and the attachment comprising a ventilation grille for air to travel through the vents to iron and remove wrinkles from the cloth; and the attachment not including a metal or steel ironing portion; and the attachment not including a traditional soleplate; and the attachment not requiring an air cushion between the apparatus and the cloth;

wherein said attachment comprising a hollow central portion, terminating in a ventilation grille panel, whereby the said hollow central portion is further comprising a shape that tapers from the proximal end towards the terminal ventilation grille panel, whereby the proximal end of said hollow central portion is further able to receive the barrel of the blow dryer, holding the barrel of the blow dryer in communication with the hollow portion of the attachment so that air from the blow dryer can pass through the ventilation grille panel;

wherein said ventilation grille panel comprising a grille surrounded by a thin marginal frame is placed on fabric or clothing, allowing the hot air to travel through the vents and remove wrinkles;

wherein said ventilation grille comprises diamond-shaped air vents spanning the entirety of the grille surface; and the proximal end of the hollow central portion attaches to the barrel of most standard blow dryers without requiring screws, or other fasteners.

3. The attachment as defined in claim 2, wherein said attachment is made integrally with a blow dryer into a single non-detachable apparatus, wherein said non-detachable apparatus comprising the body shape and design of the attachment is incorporated into a single composite heat resistant shell for the internal mechanical components of a blowdryer.

4. The attachment as defined in claim 2, wherein said attachment can be used to dry cloth that is damp or wet.

5. The method as defined in claim 1, wherein the method can be used to dry cloth that is damp or wet.

6. The method as defined in claim 1, wherein said attachment is made integrally with a blow dryer into a single non-detachable apparatus, wherein said non-detachable apparatus comprising the body shape and design of the attachment is incorporated into a single composite heat resistant shell for the internal mechanical components of a blowdryer.

* * * * *